US008425264B2

(12) United States Patent
Michell et al.

(10) Patent No.: US 8,425,264 B2
(45) Date of Patent: Apr. 23, 2013

(54) ELECTRICAL CONNECTOR

(75) Inventors: Adrian P. Michell, Naples, FL (US); Roy K. Warner, Lehigh Acket, FL (US)

(73) Assignee: Pan Electric Corporation, Carson City, NV (US)

( * ) Notice: Subject to any disclaimer, the term of this patent is extended or adjusted under 35 U.S.C. 154(b) by 7 days.

(21) Appl. No.: 13/231,318

(22) Filed: Sep. 13, 2011

(65) Prior Publication Data

US 2012/0100762 A1 Apr. 26, 2012

Related U.S. Application Data

(60) Provisional application No. 61/383,622, filed on Sep. 16, 2010.

(51) Int. Cl.
*H01R 4/40* (2006.01)

(52) U.S. Cl.
USPC ..... 439/789; 439/907

(58) Field of Classification Search ..... 439/789, 439/790, 791, 907
See application file for complete search history.

(56) References Cited

U.S. PATENT DOCUMENTS

| | | | | |
|---|---|---|---|---|
| 3,181,422 | A | 6/1964 | Lawlor | |
| 3,351,889 | A | 11/1967 | Lawlor et al. | |
| 3,406,372 | A | 10/1968 | Lawlor | |
| 3,980,381 | A | 9/1976 | Cornell | |
| 3,990,129 | A | 11/1976 | Cornell et al. | |
| 4,126,918 | A | 11/1978 | Cornell | |
| 4,357,068 | A | 11/1982 | Cornell et al. | |
| 4,479,694 | A | 10/1984 | Cornell et al. | |
| 4,548,462 | A | 10/1985 | Cornell | |
| 4,573,757 | A | 3/1986 | Cochran et al. | |
| D296,777 | S | 7/1988 | Cornell | |
| 4,861,290 | A | 8/1989 | Halmstad et al. | |
| 4,898,551 | A | 2/1990 | Cornell | |
| 5,167,526 | A * | 12/1992 | Pinyan et al. | 439/411 |

(Continued)

FOREIGN PATENT DOCUMENTS

| | | |
|---|---|---|
| CN | 1280716 | 1/2001 |
| GB | 0563909 | 9/1944 |
| GB | 1145085 | 3/1969 |
| WO | WO 99/30386 | 6/1999 |

OTHER PUBLICATIONS

International Search Report for International Application No. PCT/US2011/051729, dated Jan. 10, 2012, 1 page.

(Continued)

*Primary Examiner* — James Harvey
(74) *Attorney, Agent, or Firm* — Brinks Hofer Gilson & Lione

(57) ABSTRACT

An electrical connector for a threaded stud may include: a connector body having a first end with a recessed portion and an anti-rotation wall extending upwardly from the recessed portion; a connector element configured to electrically connect and secure the threaded stud thereto; and a fastener configured to secure said connector element to the connector body. The connector element is selectively attached to the connector body in either a right-hand configuration, in which the threaded stud is secured on a right side of the connector body, or a left-hand configuration, in which the threaded stud is secured on a left side of the connector body. The anti-rotation wall engages a side wall of the connector element to prevent the connector element from rotating about the fastener relative to the connector body.

20 Claims, 4 Drawing Sheets

U.S. PATENT DOCUMENTS

| | | | | |
|---|---|---|---|---|
| 5,401,194 | A | 3/1995 | Cornell | |
| 5,466,176 | A | 11/1995 | Cornell et al. | |
| 5,690,516 | A | 11/1997 | Fillinger | |
| 5,765,962 | A | 6/1998 | Cornell et al. | |
| 5,919,065 | A * | 7/1999 | Warner et al. | 439/789 |
| 6,241,563 | B1 * | 6/2001 | Warner et al. | 439/789 |
| 6,347,967 | B1 | 2/2002 | Tamm | |
| 6,579,131 | B1 | 6/2003 | Ashcraft et al. | |
| 7,175,484 | B1 | 2/2007 | Tamm et al. | |
| 8,277,263 | B1 * | 10/2012 | Smith | 439/779 |
| 2003/0047400 | A1 * | 3/2003 | Warner | 191/6 |
| 2007/0064769 | A1 | 3/2007 | Hillman | |
| 2012/0100762 | A1 * | 4/2012 | Michell et al. | 439/789 |

OTHER PUBLICATIONS

Written Opinion of the International Searching Authority for International Application No. PCT/US2011/051729, dated Jan. 10, 2012, 7 pages.

* cited by examiner

FIG. 2
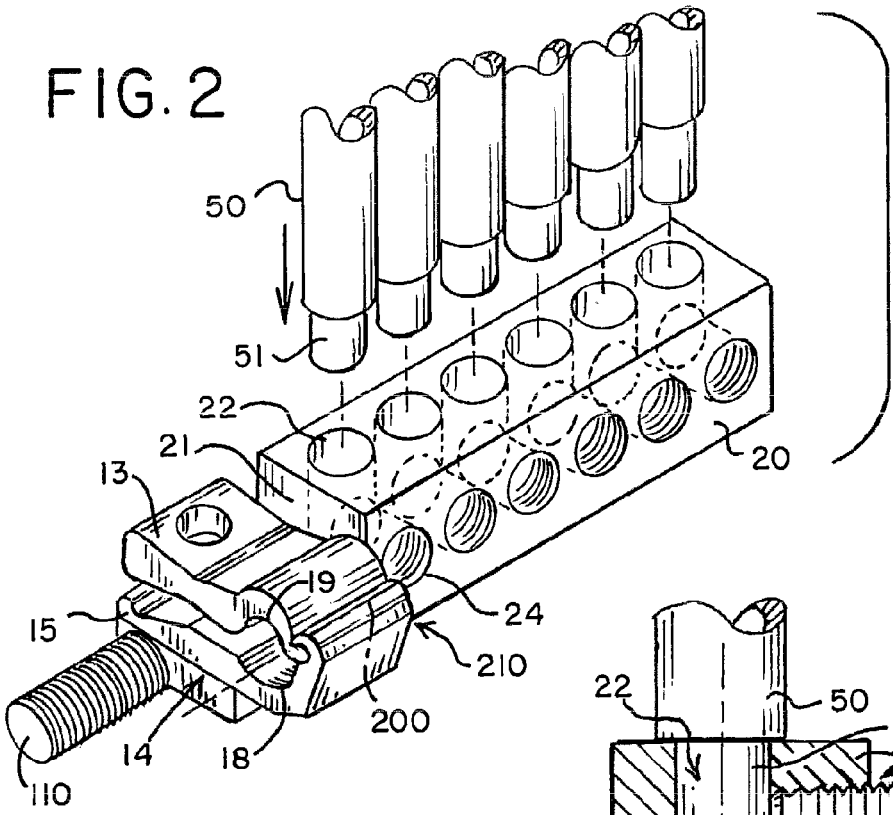
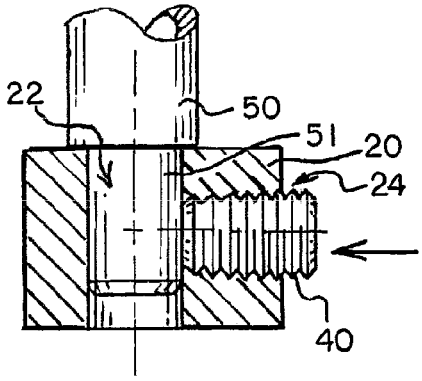
FIG.3
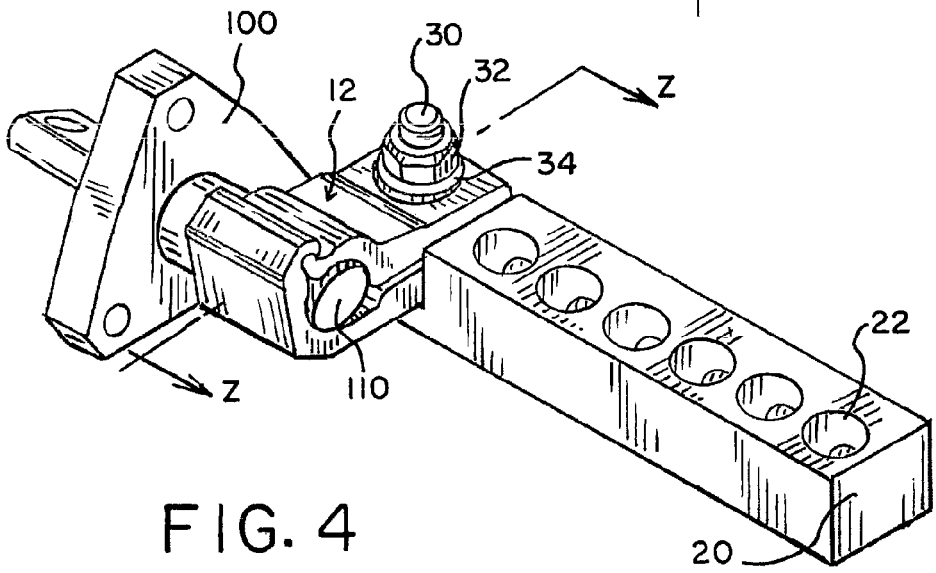
FIG. 4

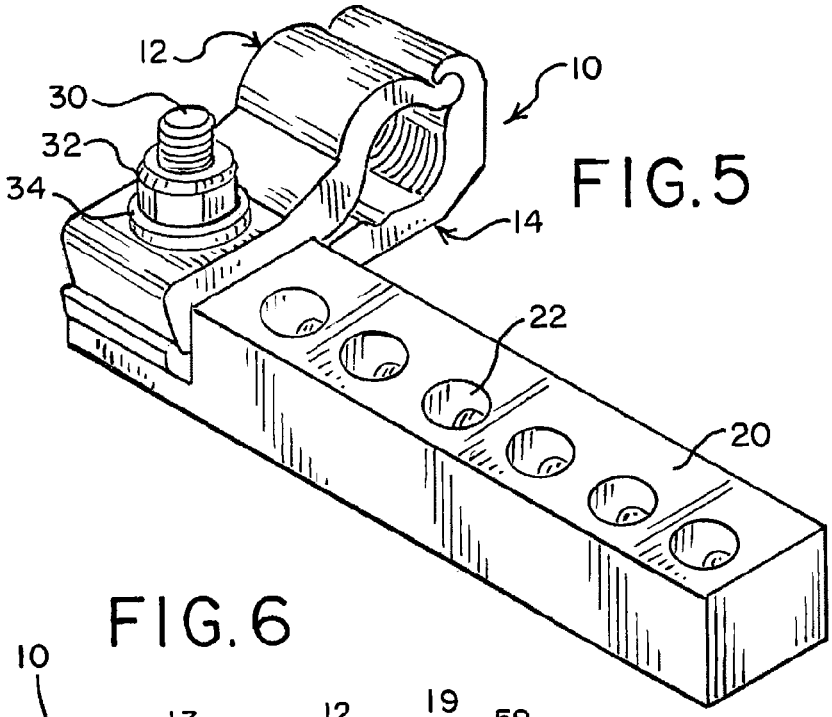
FIG. 5
FIG. 6
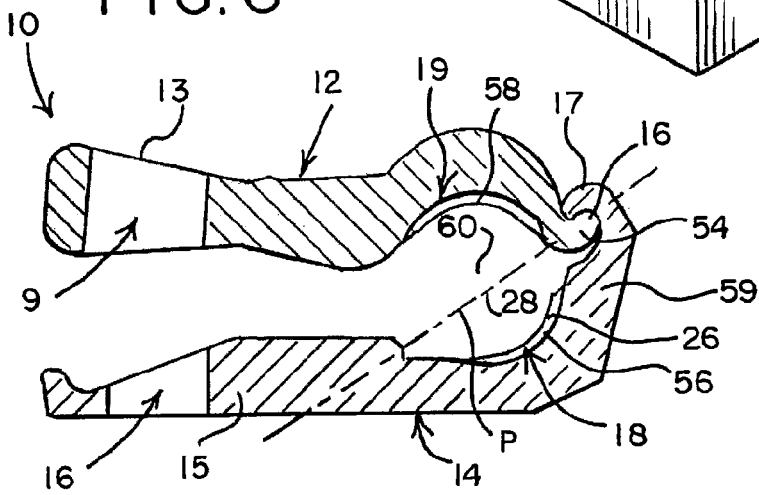
FIG. 7a
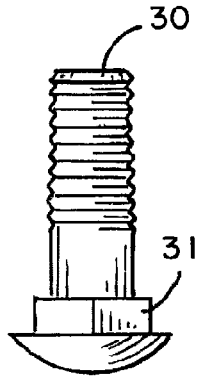
FIG. 7
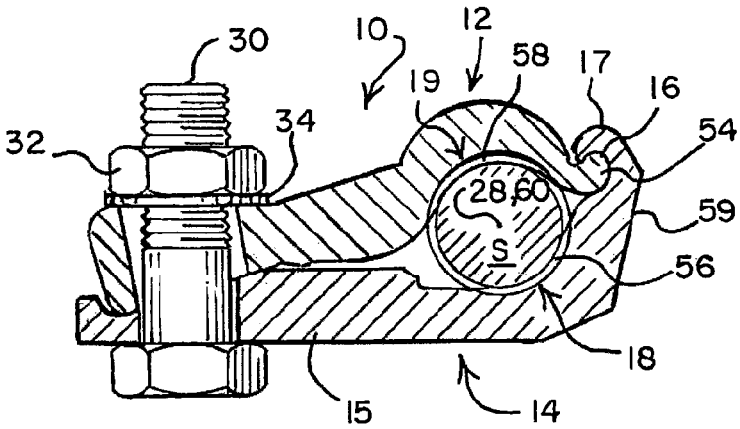

ELECTRICAL CONNECTOR

This application claims the benefit of U.S. Provisional Application No. 61,383,622, filed Sep. 16, 2010, the entire disclosure of which is hereby incorporated herein by reference.

BACKGROUND

1. Field of the Invention

The present invention generally relates to electrical connectors for shafts and cables, and in particular to an improved electrical connector for a threaded shaft for an electrical transformer or other electrical component.

2. Technical Background

Electrical connectors are commonly employed to connect electrical components, for example, a power transformer, to cables, bushings, and shafts in electrical systems. In a typical electrical power distribution system, a transformer is commonly used to step down a higher voltage to a lower voltage that is more compatible with consumer electrical needs. By stepping down the voltage, power loss is minimized as electricity is delivered over power lines and the like. A transformer typically includes an output conductor in the form of a threaded stud. The threaded stud conductor is then connected to a plurality of individual electrical conductors by a transformer stud connector. In such cases, the transformer stud connectors are typically connected to the threaded stud conductor by either a screw-on threaded connection or a more convenient slip-fit connection.

A typical screw-on connector includes a stud receiving passageway having a threaded, annular shape that extends into a body of the connector. In operation, the threaded stud conductor of the transformer or other electrical component is screwed into the conductor receiving passageway by rotating the connector relative to the stud conductor. Once the threaded stud is inserted to a desired degree into the connector, a locknut that is threadably disposed on the stud is tightened against the connector body to fix the orientation of the connector body to the stud. The connector body also typically includes a plurality of conductor receiving passageways and a plurality of corresponding fastener receiving passageways. Each of the fastener passageways is connected to the corresponding conductor receiving passageways to allow a fastener, for example, a set screw or the like, to be advanced through the fastener passageway and bear against the conductor to lock it in place.

Typical slip-fit connectors include a connector passageway that extends into a body of the connector and is sized slightly larger than the threaded stud connector of the transformer to facilitate insertion thereof. The connector also includes one or more threaded locking fastener passageways disposed in the connector body. Each of the fastener passageways is oriented transverse to and connects with the connector passageway. A locking fastener, for example, a set screw or the like, is then inserted into each of the fastener passageways and threadably advanced into the connector body until the fasteners contact and bear against the threaded stud connector to lock the connector in place and achieve an electrical connection to the transformer stud.

BRIEF SUMMARY

In one aspect, an electrical connector may include an electrical connector for a threaded stud. The electrical connector may include: a longitudinally extending connector body having a first end, where the first end comprises a recessed portion and an anti-rotation wall extending upwardly from the recessed portion; a connector element configured to electrically connect and secure a threaded stud thereto; and a fastener configured to secure the connector element to the connector body. The connector element may be selectively attached to the connector body in either a right-hand configuration, in which the threaded stud is secured on a right side of the connector body, or a left-hand configuration, in which the threaded stud is secured on a left side of the connector body. When the connector element is in the right hand configuration, the anti-rotation wall engages a first side wall of the connector element and when the connector element is in the left hand configuration, the anti-rotation wall engages a second side wall of the connector element. Through this engagement, the anti-rotation wall may prevent the connector element from rotating about the fastener relative to the connector body when torqued.

In another aspect, the connector element may include: a first stud connector comprising a first threaded portion having a partially-cylindrical shape that extends less than 180 degrees around a cylindrical arc; a first hinge member disposed on one side of the first threaded portion, and a first tail portion disposed on another side of the first threaded portion. The first tail portion may extend away from the first threaded portion. The connector element may also include a second stud connector comprising a second threaded portion having a partially-cylindrical shape that extends less than 180 degrees around the cylindrical arc, a second hinge member disposed on one side of the second threaded portion, and a second tail portion disposed on another side of the second threaded portion. The second tail portion may extend away from the second threaded portion. The hinge elements may be coupled together at a hinge axis such that the first and second stud connectors rotate about the hinge axis to selectively move the first and second threaded surfaces toward and away from one another. The threaded surfaces may be oriented to contact and intermesh with opposed sides of the threaded stud. The fastener may be configured to secure the tail portions together and clamp the threaded stud between the threaded surfaces.

In another aspect, the first and second stud connectors are cantilevered off a right side of the connector body in the right hand configuration, and the first and second stud connectors are cantilevered off a left side of the connector body in the left hand configuration.

In yet another aspect, the recessed portion may include a laterally extending slot. The first and second stud connectors may be slidingly adjustably secured to the connector body by the fastener in either the right hand or left hand configurations, with the fastener extending through the slot and apertures disposed in the first and second tail portions of the first and second stud connectors, respectively.

In one aspect, opposing side walls defining the slot are configured to engage with an anti-rotation member of the fastener, such that the side walls defining the slot and the anti-rotation member cooperate to prevent rotation of the fastener under torque.

A method of connecting a connector body to a threaded stud of an electrical transformer may include providing a longitudinally extending connector body having a first end, where the first end comprises a recessed portion and an anti-rotation wall extending upwardly from the recessed portion. The recessed portion may comprise a laterally extending slot disposed thereon. A first stud connector may be provided. The first stud connector may comprise a first threaded portion having a partially-cylindrical shape that extends less than 180 degrees around a cylindrical arc, a first hinge member disposed on one side of the first threaded portion, and a first tail portion disposed on another side of the first threaded portion, the first tail portion may extend away from the first threaded portion. A second stud connector may also be provided. The second stud connector may comprise a second threaded portion having a partially-cylindrical shape that extends less than 180 degrees around the cylindrical arc, a second hinge member disposed on one side of the second threaded portion, and a second tail portion disposed on another side of the second threaded portion, where the second tail extends away from the second threaded portion. The hinge elements may be coupled together at a hinge axis such that the first and second stud connectors rotate about the hinge axis to selectively move the first and second threaded surfaces toward and away from one another. The threaded surfaces may be oriented to contact and intermesh with opposed sides of the threaded stud.

The first and second stud connectors may be selectively rotated and attached to the connector body in either a right-hand configuration, in which the first and second stud connectors are disposed on a right side of the connector body or a left-hand configuration, in which the first and second stud connectors are disposed on a left side of the connector body. The threaded stud may be inserted into a space disposed between the first and second threaded portions. A fastener may be inserted through an aperture disposed in the bottom portion and through apertures disposed in the first and second tail portions. The fastener may then be tightened to clamp the threaded stud between the threaded surfaces. When the fastener is tightened, the first and second tail portions elastically deform toward each other and exert a continuous spring compression force on the threaded stud.

In one aspect, when the first and second stud connectors are in the right hand configuration, the anti-rotation wall engages a side wall of the second stud connector and when the first and second stud connectors are in the left hand configuration, the anti-rotation wall engages a second side wall of the second stud connector, the anti-rotation wall thereby preventing the stud connector from rotating about the fastener relative to the connector body when the fastener is tightened.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

BRIEF DESCRIPTION OF THE DRAWINGS

FIG. 2 is a partially assembled perspective view of the electrical connector of FIG. 1.

FIG. 3 is a side cross-sectional view taken along the line X-X, which is perpendicular to the plane Y of FIG. 1, and illustrates the connection between the slip-fit conductors and the electrical connector.

FIG. 4 is a perspective view of the electrical connector of FIG. 1 in a fully assembled, left hand configuration.

FIG. 5 a perspective view of the electrical connector of FIG. 1 in a fully assembled, right hand configuration.

FIG. 6 is a side cross-sectional view taken along the line Z-Z of FIG. 4, illustrating a connector element in an open position.

FIG. 7 side cross-sectional view taken along the line Z-Z of FIG. 4, illustrating a connector element in a closed position.

FIG. 7*a* is a side elevation view of a fastener having an anti-rotation feature.

DETAILED DESCRIPTION OF THE DRAWINGS AND THE PRESENTLY PREFERRED EMBODIMENTS

The term longitudinal and its derivatives refer to a generally lengthwise extending direction. The term lateral and its derivatives refer to a direction extending sideways and substantially perpendicular to the longitudinal direction.

Figure 1:
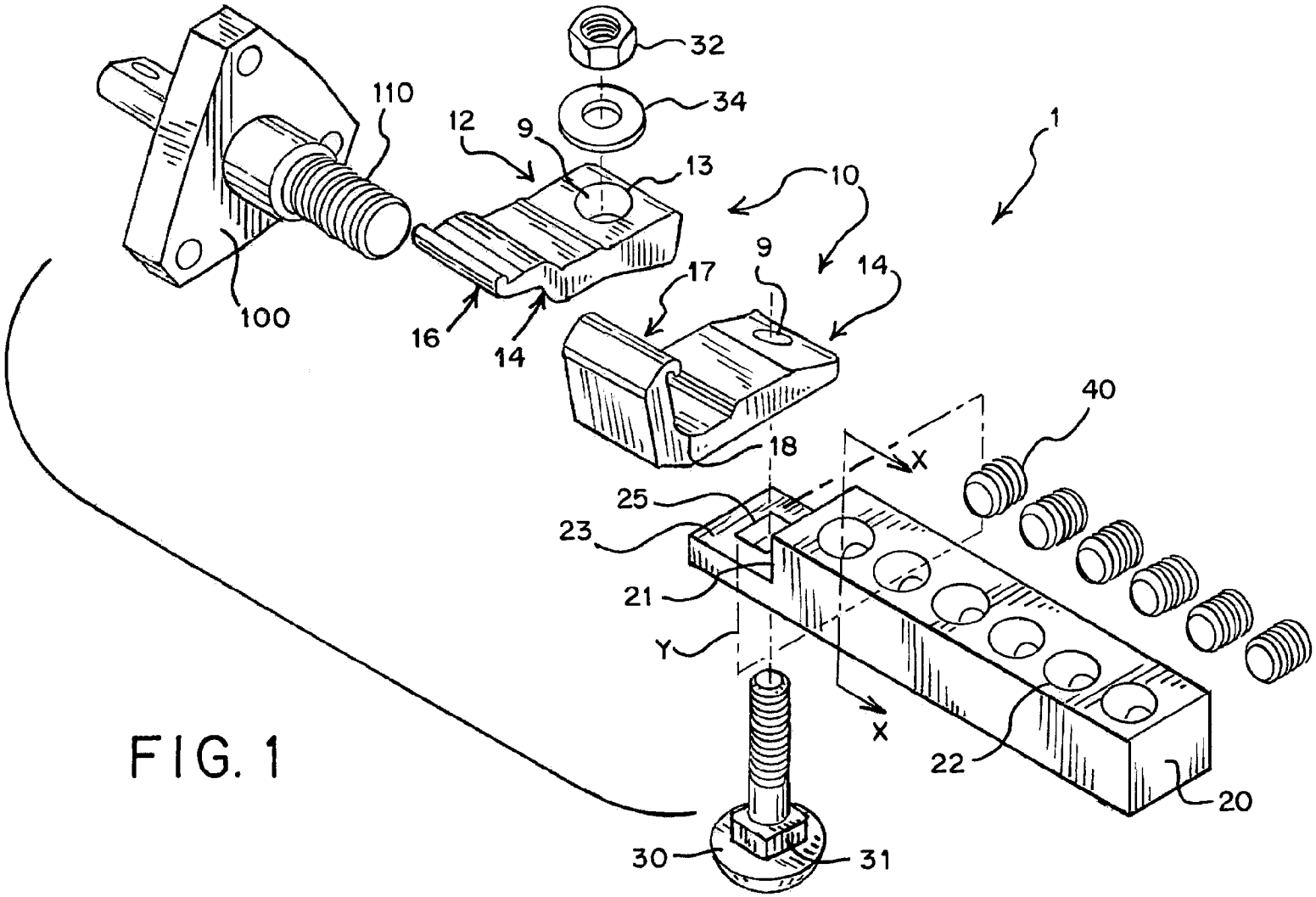
FIG. 1 is an exploded perspective view of an embodiment of an electrical connector.

Turning to the drawings, FIGS. 1-7 illustrate a first embodiment of an electrical connector 1. The electrical connector may be, for example and without limitation, a neutral bar or phase bar connector configured to interface with, and electrically connect to a transformer or other electrical component having a threaded (or non-threaded) stud-like electrical connector. As shown in the embodiment of FIG. 1, the electrical connector may include a connector element 10 that is removably attached to a connector body 20 by a fastener 30 such as, for example, a bolt. The connector body 20 may be a neutral bar or phase bar and may include a plurality of slip fit connector bores (apertures) 22. As shown in FIGS. 2 and 3, each connector bore 22 is sized slightly larger than an electrically conductive end 51 of an electrical conductor 50. Exemplary electrical conductors may include, without limitation, cables, bushings, and the like. The connector body 20 also includes a plurality of corresponding set screw bores 24 (apertures) having a threaded inner surface. As shown in FIG. 2, each set screw bore 24 extends is disposed in longitudinal alignment with the slip-fit bores 22 and extends laterally inward toward a center of the connector body 20 such that the set screw bore 24 connects to the slip-fit bore 22 and forms an annular, L-shaped cavity. In operation, the electrical conductor is inserted into the bore 22 such that the tip 51 extends into the portion of the set screw bore 22 that is in communication with the set screw bore 24, as shown in FIG. 3. A set screw 40 is then threadably advanced through the set screw bore 24 until it contacts the tip 51 and forces the tip 51 against an opposing wall of the slip-fit connector bore 22, thereby effecting an electrical and physical connection between the connector body 20 and the electrical conductor 50.

Returning to FIG. 1, the connector body 20 includes a recessed portion 23 disposed at a forward end thereof, and an anti-rotation wall 21 disposed adjacent a rearward end of the recessed portion 23. The recessed portion 23 may be formed integrally with the connector body 20 by milling down a forward portion thereof, or it may be a separate component that is rigidly attached to the connector body 20 by, for example, welding, adhesives, mechanical fasteners or the like. The anti-rotation wall 21 extends above an upper surface of the recessed portion 23 by an amount that is sufficient to provide an adequate reaction surface to engage a laterally extending side surface of the connector member 10 when the connector member 10 is attached to the connector body 20. For example and without limitation, the anti-rotation wall 21 may have a height between 13/16 and 1/4 inches. The recessed portion 23 also includes an aperture 25 extending through its thickness to receive the fastener 30. The aperture 25 may have an anti-rotation, non-circular shape that is configured to engage and cooperate with an anti-rotation feature of the fastener 30. For example, as shown in FIG. 1, both the fastener 30 and the aperture 25 may have a square shaped anti-rotation feature, with the aperture 25 being sized slightly larger than the square portion of the fastener 30 to allow easy insertion therethrough. However, it should be understood that the shape of the anti-rotational feature of the aperture 25 and the bolt 30 is not limited thereto and may be any non-circular shape, for example and without limitation, triangular, hexagonal, and octagonal. Moreover, it should be understood that both the aperture 25 and the bolt 30 may not include any anti-rotational features.

The connector element 10 may include a male stud connector 12 and a female stud connector 14. The male stud connector 12 may include a tail portion 13, a partial cylindrical surface 19, a hinge portion 16 and a fastener aperture 9. Similarly, the female stud connector 14 may include a tail portion 15, a partial cylindrical surface 18, a hinge portion 17 and a fastener aperture 9.

As shown in FIGS. 6 and 7 the tail portion 15 of the female stud connector 14 may include and an upwardly extending flange 59 disposed at one end of the tail portion 15. The flange 59 terminates in a curved, somewhat C-shaped female hinge element 17. The hinge element 17 defines a hinge axis 200 (see FIG. 2) that extends transversely along an inner surface thereof and operates as described below to control hinging movement of the connector element 10. However, it should be understood that the term "hinge element" is intended to broadly encompass any type of hinge having portions that directly engage one another as shown in the drawings, as well as barrel elements that engage separate pins and pin elements that engage separate barrels.

A first partial cylindrical surface 18 is formed on the upper surface of the female stud connector 12 near the junction between the flange 59 and the tail portion 15. The partial cylindrical surface 18 extends over a cylinder arc (measured with respect to an axis 28 of a cylinder that is parallel to the hinge axis 200) that is less than 180 degrees. The partial cylindrical surface 18 may extend less than 160 degrees around the cylinder, and may extend less than 140 degrees around the cylinder. In one embodiment, the partial cylindrical surface 18 extends 110 degrees. The partial cylindrical surface 18 may have a first threaded surface 58 that defines an array of threads.

A male stud connector 12 may include a second tail portion 13, a male hinge element 54, and a second partial cylindrical surface 19. Like the partial cylindrical surface 18, the partial cylindrical surface 19 extends over a cylinder arc (measured with respect to an axis 60 of a cylinder that is parallel to the hinge axis 200) that is less than 180 degrees. The partial cylindrical surface 19 may extend less than 160 degrees around the cylinder, and may extend less than 140 degrees around the cylinder. In one embodiment, the partial cylindrical surface extends 110 degrees. The second partial cylindrical surface 19 may include a threaded surface 56. The second threaded surface 56 defines an array of threads 58 that are partially cylindrical in shape and that are centered on a second cylinder axis 60. The threads 56, 58 are matched with one another such that they have the same cylinder diameter and the same number of threads per inch. The second cylinder axis 60 is parallel to the first cylinder axis 28.

The male and female stud connectors 12, 14 can be formed from an extrusion of a conductive alloy such as AL 6082-T6. This extrusion may then machined to form the various features described above. The recess in the flange 59 below the hinge axis 200 may be formed by machining or extrusion techniques. Alternatively, the male and female stud connectors may be cast metal parts.

As shown in FIG. 6, a plane P passing through the hinge axis 200 and the cylinder axis 28 also passes through the first tail portion 15. When the male stud connector 12 is positioned to clamp the threaded stud 110, the first tail portion 15 is oriented generally tangentially to the first threaded surface 56.

In operation, the male and female stud connectors 12, 14 are clamped in position by a fastener 30 and a nut 34. Note that while the fastener 30 is shown as a standard bolt having no anti-rotational features, a fastener, for example, a carriage bolt, having an anti-rotational element, such as those shown in FIGS. 1 and 7*a,* may also be used to allow one-handed installation. The connector 10 is first assembled as shown in 2, 4, and 5. The male stud connector 12 is then rotated clockwise in the view of FIG. 6 to separate the threaded surfaces 58, 56. The threaded stud 110 is then positioned between the threaded surfaces 58, 56 by moving the threaded stud 110 or the female stud connector 14 parallel to the hinge axis 200. The fastener 30 is inserted through the aperture 25 in the recessed portion 23 and the fastener apertures 9 of the male and female stud connectors 12, 14. A wrench is then used to rotate the nut 32 on the fastener 30. In embodiments employing the anti-rotation aperture 25 and fastener 30, this tightening process can be achieved with a single hand as the anti-rotation features cooperate to prevent rotation of the fastener 30 relative to the connector element 10 when the nut 32 is torqued. Regardless of whether the anti-rotation features are present in the fastener 30 or the recessed portion 23, when the nut 32 is torqued, the anti-rotation wall 21 contacts and engages at least a portion of a laterally extending side surface of the female stud connector 14, or the male stud connector 12, or both the male and female stud connectors 12, 14. In this way, the connector element 10 is prevented from rotating and held substantially stationary while the tale portions 13, 15 are clamped around the threaded stud 110.

Rotation of the nut 32 moves the second tail portion 13 into contact with the tail portion 15, thereby clamping the first and second threaded surfaces 58, 56 against opposed sides of the threaded stud 110 and causing the first and second threads 58, 56 to intermesh with opposed threads on the threaded stud 110. The hinge elements 17, 16 allow sufficient axial movement along the hinge axis 200 to ensure that the respective threads intermesh on both sides of the threaded stud 110. When tightly clamped against the threaded stud 110, the first and second cylinder axes 28, 60 are coincident with the center of the threaded stud 110. The result is a secure mechanical and electrical connection with the threaded stud 110 that is obtained without the requirement of any relative rotation between the threaded stud 110 and the connector element 10.

Additionally, the male and female stud connectors 12, 14 cooperate to form a spring compression connector that provides a secure, long-term, low-resistance connection with the stud 110. The male stud connector 12 is shaped such that the second tail portion 13 is spaced from the tail portion 15 of the female stud connector 14 when the threaded surfaces 58, 56 are fully intermeshed with the threads of the stud 110. As the fastener 30 is used to clamp the second tail portion 13 against the first tail portion 15, the second tail portion 13 and the first tail portion 15 are elastically deformed. This elastic deformation provides stored energy that maintains a high contact compressive spring force on the stud 110 over an extended time period, in spite of vibration, thermal cycling and cold flow. This contact force may be sufficient to create a gas-tight seal with the threads of the stud 110, thereby reducing or even substantially eliminating problems associated with corrosion or electrochemical reactivity at the stud 110. In order to enhance the spring compression effect, it is preferred to use a material for the male and female stud connectors 12, 14 that acts as a spring (i.e. deforms elastically rather than plastically) under operational conditions. Of course, it should be understood that in embodiments where the partial cylindrical surfaces 18, 19 do not employ threaded surfaces 58, 56, the male and female stud connectors still achieve substantially the same result and achieve the same compressive spring-like physical and electrical connection with the threaded stud 110.

Elastic, compressive spring contact between the connector element 10 and the threaded stud 110 offers significant benefits over traditional slip fit and thread fit neutral bar and phase bar connectors. For example, in a typical slip-fit neutral bar connector, the connection for the threaded transformer stud 110 is essentially the same as the electrical conductor 50 described above in connection with FIG. 1. That is, the threaded connector 110 is simply held in place using a set screw. Accordingly, the contact between the slip-fit bore and the threaded stud 110 is minimal and varies from approximately 10 to 135 degrees total. This contact has no stored energy (e.g. spring) in it and is thus susceptible to heat related losses in connection quality as the materials expand and contract. Further, as the connector heat cycles, it transfers heat to the threaded stud 110, which can cause the glastic seal of the electrical transformer, in which the threaded stud 110 is set, to crack. If the glastic seal cracks, it allows mineral oil disposed in the primary side of the transformer to migrate into the secondary chamber. This process shorts out the internal components eventually leads to the collapse of the transformer and a cessation of electrical supply. In contrast, the male and female stud connectors 12, 14 provide a much higher quality contact over more of the surface of the threaded stud 110, which produces a more efficient thermal coupling that helps draw heat away from the stud 110 and reduce thermal load on the bushing, thereby reducing the likelihood of thermal failure.

As shown in FIGS. 4 and 5, the connector element 10 can be selectively attached to the connector body 20 in a left hand configuration or a right hand configuration. In the left hand configuration, the partial cylindrical surfaces 18, 19 of the male and female stud connectors 12, 14 are disposed on the left side of the connector body 20 in a cantilevered manner (FIG. 4). In the right hand configuration, the partial cylindrical surfaces 18, 19 of the male and female stud connectors 12, 14 are disposed on the right side of the connector body in a cantilevered manner (FIG. 5). Thus, a single electrical connector assembly can be used for transformers that require either a right hand or a left hand configuration due to clearance issues or the like. Further, because the connector element 10 can be easily reversed in two directions simply by loosening the clamp and turning it in the opposite direction, technicians installing the connector have much more flexibility when dealing with transformers from different manufacturers, which, due to orientation, may have cables that are too short for a standard neutral bar connector. The reversible configuration may provide an adjustable range of at least 4½ inches.

Figure 8:
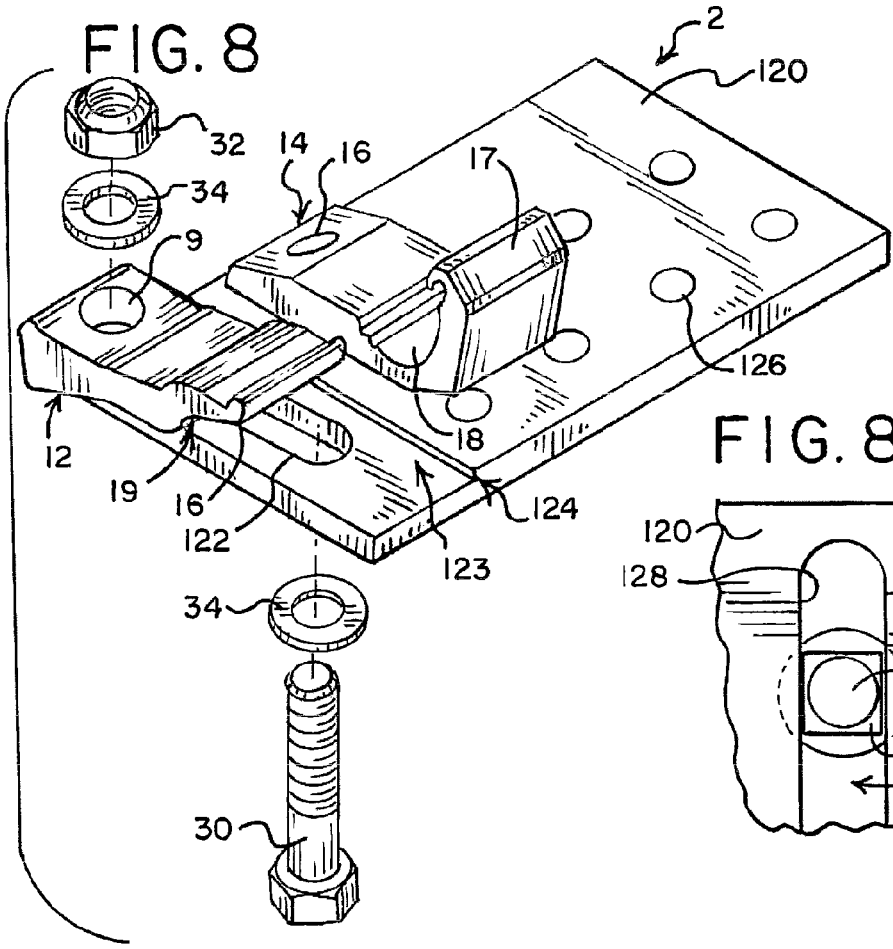
FIG. 8 is an exploded perspective view of another embodiment of an electrical connector.
Figure 9:
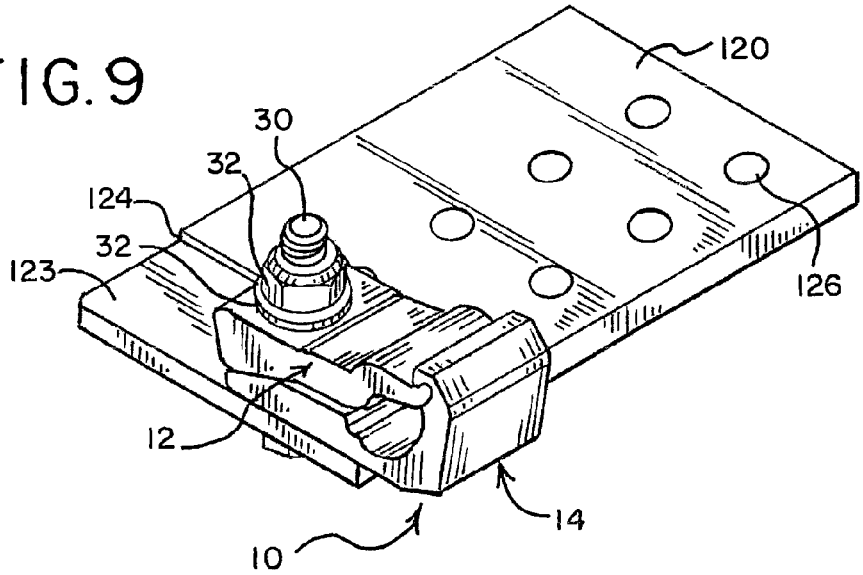
FIG. 9 is a perspective view of the electrical connector of FIG. 8 in an assembled configuration.

FIGS. 8 and 9 illustrate another embodiment of an electrical connector 2. The electrical connector 2, may include a connector element 10 that is removably attached to a connector body 120 in a slidably adjustable manner by a fastener 30 such as, for example, a bolt, and a nut 32 and a washer 34. The connector element 10 of the electrical connector 2 is substantially the same as the connector element 10 of the electrical connector 1 of FIGS. 1-7, and will therefore not be described again in detail.

Like the connector body 20 of the electrical connector 1, the connector body 2 may include a recessed portion 123 and an anti-rotation wall 124. However, unlike the neutral bar connector of the electrical connector 1, the connector body 120, which may be a bus bar, does not include electrical connectors for slip fit or other electrical connectors. Rather, the connector body 120 comprises a plurality of attachment or mounting apertures for attaching one or more devices configured to directly connect slip-fit or threaded electrical connectors (e.g., cables, bushings, threaded studs, etc.). For example, electrical connectors such as those described in U.S. Pat. No. 6,347,967, which is assigned to Pan Electric Corporation, the Assignee of the present application, and hereby incorporated by reference in its entirety, and the CYTOLOK Clamp sold by Pan Electric Corporation. The recessed portion 123 also includes a laterally extending slot 122 that allows the connector element 10 to be slidably attached and adjustable in the lateral direction. In one embodiment, the slot 122 may be about 2.0 inches in length. In other embodiments, the slot 122 may have a length of between 2 and 3 inches.

In one embodiment, a slot may have a length of 2 1/16 inches that provides an adjustable range of around 6¼ inches. This adjustable range may provide the installer with useful space when installing the electrical connector on a different makes (brands) or models of transformers having phase bars arranged differently than the transformer it replaced. Alternately the installer can use the adjustable feature to compensate for shortened cables or conductors, which have been cut short to remove failed or otherwise faulty connectors. This is a common problem faced by electrical workers who lose much time and incur great cost, when rectifying this problem. The anti-rotation wall 124 is disposed adjacent a rearward end of the recessed portion 123. The recessed portion 123 may be formed integrally with the connector body 120 by milling down a forward portion thereof or may be a separate component that is rigidly attached to the connector body 120 by, for example, welding, adhesives, mechanical fasteners or the like. The anti-rotation wall 124 extends above an upper surface of the recessed portion 123 by an amount that is sufficient to provide an adequate reaction surface to engage a laterally extending side surface of the connector member 10 when the connector member 10 is attached to the connector body 120.

Like the electrical connector 1, the connector element 10 of the electrical connector 2 can be selectively attached to the connector body 120 in a left hand configuration or a right hand configuration. In the left hand configuration, the partial cylindrical surfaces 18, 19 of the male and female stud connectors 12, 14 are disposed on the left side of the connector body 20. In the right hand configuration, the partial cylindrical surfaces 18, 19 of the male and female stud connectors 12, 14 are disposed on the right side of the connector body. Depending on the lateral position of the connector within the slot 122, the partial cylindrical surfaces 18, 19 may or may not be cantilevered over the right or left hand side of the connector body 120. Thus, the electrical connector 2 allows the same type of right hand/left hand flexibility in adapting to a wide range of transformer and connector configurations, but adds additional flexibility in use due to the slot 122.

Figure 8A:
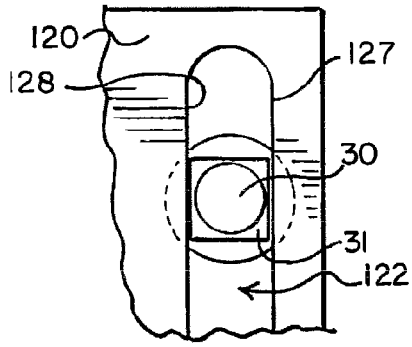
FIG. 8*a* is a close up top view of a slot of the electrical connector of FIG. 8 and a fastener having an anti-rotation feature.

While FIGS. 8 and 9 illustrate a standard cylindrical fastener 30, as shown in FIG. 8*a*, a carriage bolt or the like having an anti-rotational feature (see e.g. FIG. 7*a*) may also be used. In this case, the slot 122 may be sized slightly larger than the anti-rotational feature of the fastener 30, for example and without limitation, the square protrusion 31 disposed below the head of the fastener 30, to allow the fastener to be easily inserted into the slot. When the fastener 30 is rotated, the anti-rotation feature 31 engages with and is restrained by the side walls 127, 128 that define the slot 122. Accordingly, the slot 122 and the anti-rotation feature 31 cooperate to prevent the fastener from rotating relative to the connector element 10 and allow one-handed securing of the electrical connector element 10 to the connector body 20. Further, regardless of what kind of fastener is used, as described above in connection with the electrical connector 1, when the nut 32 is torqued, the anti-rotation wall 124 contacts and engages at least a portion of a laterally extending side surface of the female stud connector 14, or the male stud connector 12, or both the male and female stud connectors 12, 14. In this way, the connector element 10 is prevented from rotating and held substantially stationary while the tale portions 13, 15 are clamped around the threaded stud 110.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. An electrical connector for a threaded stud, said electrical connector comprising:

a longitudinally extending connector body having a first end, said first end comprising a recessed portion and an anti-rotation wall extending upwardly from said recessed portion;

a connector element configured to electrically connect and secure a threaded stud thereto; and a fastener configured to secure said connector element to said connector body, wherein said connector element is selectively attached to said connector body in either a right-hand configuration, in which said threaded stud is secured on a right side of said connector body, or a left-hand configuration, in which said threaded stud is secured on a left side of said connector body, and wherein, when said connector element is in said right hand configuration, said anti-rotation wall engages a first side wall of said connector element and when said connector element is in said left hand configuration, said anti-rotation wall engages a second side wall of said connector element, said anti-rotation wall thereby preventing said connector element from rotating about said fastener relative to said connector body.

2. The connector of claim 1, wherein said connector element comprises:

a first stud connector comprising a first threaded portion having a partially-cylindrical shape that extends less than 180 degrees around a cylindrical arc, a first hinge member disposed on one side of said first threaded portion, and a first tail portion disposed on another side of said first threaded portion, said first tail portion extending away from said first threaded portion;

a second stud connector comprising a second threaded portion having a partially-cylindrical shape that extends less than 180 degrees around said cylindrical arc, a second hinge member disposed on one side of said second threaded portion, and a second tail portion disposed on another side of said second threaded portion, said second tail portion extending away from said second threaded portion;

wherein said hinge elements are coupled together at a hinge axis such that said first and second stud connectors rotate about said hinge axis to selectively move said first and second threaded surfaces toward and away from one another, said threaded surfaces being oriented to contact and intermesh with opposed sides of said threaded stud; and wherein the fastener is configured to secure said tail portions together and clamp said threaded stud between said threaded surfaces.

3. The electrical connector of claim 1, wherein said first and second stud connectors are cantilevered off a right side of said connector body in said right hand configuration, and said first and second stud connectors are cantilevered off a left side of said connector body in said left hand configuration.

4. The electrical connector of claim 1, wherein said recessed portion comprises an anti-rotation aperture that is shaped to engage with an anti-rotation member of said fastener, wherein side walls defining said anti-rotation aperture and said anti-rotation member cooperate to prevent rotation of said fastener under torque.

5. The electrical connector of claim 1, wherein said connector body is a neutral bar connector.

6. The electrical connector of claim 5, wherein said neutral bar connector comprises a plurality of slip-fit connectors shaped to receive and electrically connect a plurality of slip-fit bushings and conductors.

7. The electrical connector of claim 1, wherein said threaded stud is a conductor for an electrical transformer.

8. The electrical connector of claim 1, wherein, when said first and second tail portions are secured by said fastener around said threaded stud, said tail portions elastically deform toward each other and exert a continuous spring compression force on said threaded stud.

9. The electrical connector of claim 7, wherein said neutral bar does not comprise a bushing receiving bore to secure said threaded stud.

10. The electrical connector of claim 2, wherein said recessed portion comprises a laterally extending slot.

11. The electrical connector of claim 10, wherein said first and second stud connectors are slidingly adjustably secured to said connector body by said fastener in either said right hand or left hand configurations, said fastener extending through said slot and apertures disposed in said first and second tail portions of said first and second stud connectors, respectively.

12. The electrical connector of claim 11, wherein said slot extends about 2 inches and provides an adjustable range of 6¼ inches.

13. The electrical connector of claim 12, wherein opposing side walls defining said slot are configured to engage with an anti-rotation member of said fastener, said side walls defining said slot and said anti-rotation member cooperating to prevent rotation of said fastener under torque.

14. The electrical connector of claim 13, wherein said connector body comprises a plurality of apertures configured to receive and secure at least one additional connector body thereto.

15. An electrical connector for a threaded stud, said electrical connector comprising:

a longitudinally extending connector body having a first end, said first end comprising a recessed portion and an anti-rotation wall extending upwardly from said recessed portion, said recessed portion comprising a laterally extending slot;

a first stud connector comprising a first threaded portion having a partially-cylindrical shape that extends less than 180 degrees around a cylindrical arc, a first hinge member disposed on one side of said first threaded portion, and a first tail portion disposed on another side of said first threaded portion, said first tail portion extending away from said first threaded portion;

a second stud connector comprising a second threaded portion having a partially-cylindrical shape that extends less than 180 degrees around said cylindrical arc, a second hinge member disposed on one side of said second threaded portion, and a second tail portion disposed on another side of said second threaded portion, said second tail portion extending away from said second threaded portion, wherein said hinge elements are coupled together at a hinge axis such that said first and second stud connectors rotate about said hinge axis to selectively move said first and second threaded surfaces toward and away from one another, said threaded surfaces being oriented to contact and intermesh with opposed sides of a threaded stud; and a fastener configured to secure said tail portions together and clamp said threaded stud between said threaded surfaces;

wherein said first and second stud connectors are selectively attached to said connector body in either a right-hand configuration, in which said first and second stud connectors are disposed a right side of said connector body, or a left-hand configuration, in which said first and second stud connectors are disposed on a left side of said connector body, and wherein said first and second stud connectors are slidingly adjustably secured to said connector body by said fastener in either said right hand or left hand configurations, said fastener extending through said slot and apertures disposed in said tail portions of said first and second stud connectors.

16. The electrical connector of claim 15, wherein said slot extends about 2 inches.

17. The electrical connector of claim 16, wherein opposing side walls defining said slot are configured to engage with an anti-rotation member of said fastener, said side walls defining said slot and said anti-rotation member cooperating to prevent rotation of said fastener under torque.

18. The electrical connector of claim 17, wherein said connector body comprises a plurality of apertures configured to receive and secure at least one additional connector body thereto.

19. A method of connecting a connector body to a threaded stud of an electrical transformer, said method comprising:

providing a longitudinally extending connector body having a first end, said first end comprising a recessed portion and an anti-rotation wall extending upwardly from said recessed portion, said recessed portion comprising a laterally extending slot;

providing a first stud connector comprising a first threaded portion having a partially-cylindrical shape that extends less than 180 degrees around a cylindrical arc, a first hinge member disposed on one side of said first threaded portion, and a first tail portion disposed on another side of said first threaded portion, said first tail portion extending away from said first threaded portion;

providing a second stud connector comprising a second threaded portion having a partially-cylindrical shape that extends less than 180 degrees around said cylindrical arc, a second hinge member disposed on one side of said second threaded portion, and a second tail portion disposed on another side of said second threaded portion, said second tail portion extending away from said second threaded portion, wherein said hinge elements are coupled together at a hinge axis such that said first and second stud connectors rotate about said hinge axis to selectively move said first and second threaded surfaces toward and away from one another, said threaded surfaces being oriented to contact and intermesh with opposed sides of a threaded stud;

selectively rotating and attaching said first and second stud connectors to said connector body in either a right-hand configuration, in which said first and second stud connectors are disposed on a right side of said connector body, or a left-hand configuration, in which said first and second stud connectors are disposed on a left side of said connector body;

inserting said threaded stud into a disposed space between said first and second threaded portions;

inserting a fastener through an aperture disposed in said bottom portion and through apertures disposed in said tail portions; and tightening said fastener to clamp said threaded stud between said threaded surfaces, said fastener, wherein, when said fastener is tightened, said first and second tail portions elastically deform toward each other and exert a continuous spring compression force on said threaded stud.

20. The method of claim 19, wherein, when said first and second stud connectors are in said right hand configuration, said anti-rotation wall engages a side wall of said second stud connector and when said first and second stud connectors are in said left hand configuration, said anti-rotation wall engages a second side wall of said second stud connector, said anti-rotation wall thereby preventing said stud connector from rotating about said fastener relative to said connector body when said fastener is tightened.

* * * * *